United States Patent [19]

Pessolano et al.

[11] 3,994,336

[45] Nov. 30, 1976

[54] TRANSFORMER FOR HEAT PIPES

[75] Inventors: Richard L. Pessolano, Sparta; Robin B. Rhodes, Ogdensburg, both of N.J.

[73] Assignee: Isothermics, Inc., Augusta, N.J.

[22] Filed: June 13, 1974

[21] Appl. No.: 478,982

Related U.S. Application Data

[63] Continuation-in-part of Ser. No. 366,193, June 1, 1973, Pat. No. 3,880,230.

[52] U.S. Cl. ..... 165/105; 122/366; 122/33

[51] Int. Cl.[2] ..... F28D 15/00

[58] Field of Search ..... 165/105; 237/67; 62/333; 122/33, 366

[56] References Cited

UNITED STATES PATENTS

| | | | |
|---|---|---|---|
| 2,181,726 | 11/1939 | Fiene | 165/105 X |
| 3,174,540 | 3/1965 | Dutton | 62/333 X |
| 3,180,405 | 4/1965 | Hinde | 165/110 X |

FOREIGN PATENTS OR APPLICATIONS

| | | | |
|---|---|---|---|
| 1,277,756 | 9/1968 | Germany | 165/105 |

*Primary Examiner*—Albert W. Davis, Jr.
*Attorney, Agent, or Firm*—Isothermics, Inc.

[57] ABSTRACT

The present invention comprises (1) a heat source, (2) a heat pipe, and (3) a thermal transformer in thermal contact with said heat pipe and proximately disposed to said heat source, whereby a uniform heat transfer from said heat source to a heating system is obtained. The thermal transformer includes (1) a container, (2) a working fluid and its vapor which are essentially in equillibrium, (3) evaporating surfaces depending from the internal surfaces of the transformer that are wetted with the working fluid and that are proximate to the heat source, and (4) condensing surfaces depending from the exterior of those areas of said heat pipe that are in thermal contact with said transformer.

10 Claims, 8 Drawing Figures

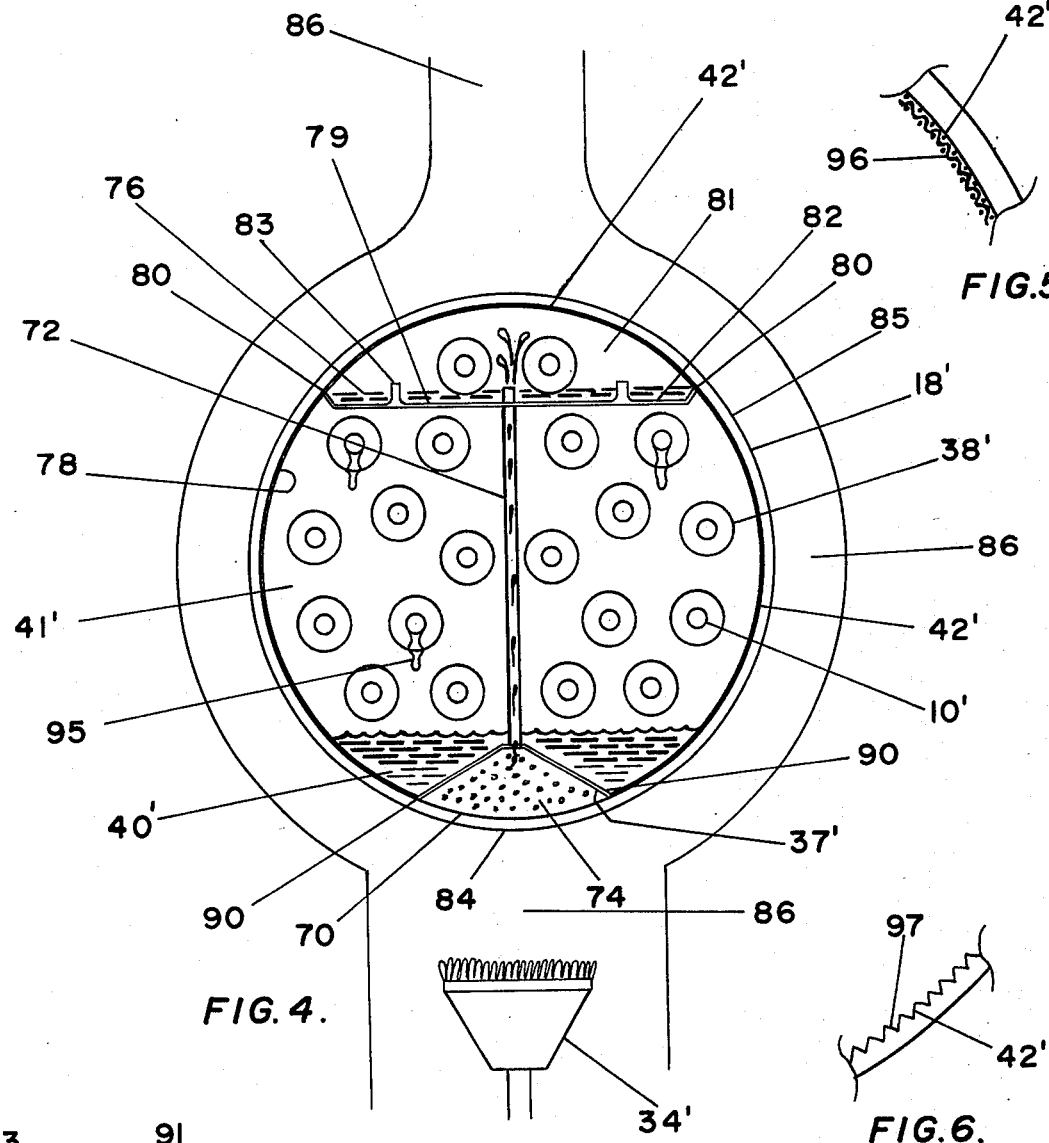
FIG. 4.
FIG. 5.
FIG. 6.
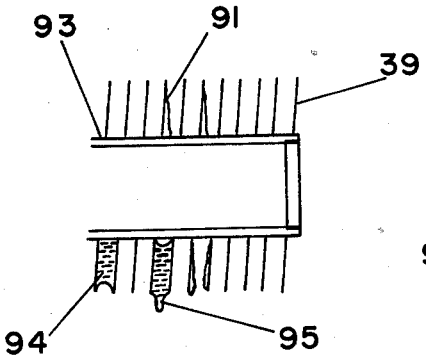
FIG. 7.
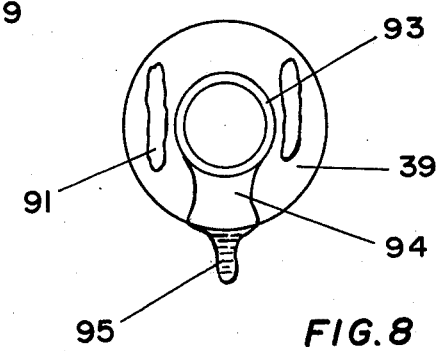
FIG. 8

TRANSFORMER FOR HEAT PIPES

REFERENCE TO PRIOR APPLICATION

This case is a Continuation-in-Part of Ser. No. 366,193, filed June 1, 1973, now U.S. Pat. No. 3,880,230, issued Apr. 29, 1975 and entitled Heat Transfer System.

BACKGROUND OF THE INVENTION

In heat pipe technology of the past, insufficient means of liquid return to the evaporative region of the heat pipe has constituted a major limitation in heat pipe designs involving high evaporation and heat fluxes. Such designs have relied heavily upon exotic arterial wick configurations in order to meet the liquid transport requirements. However, even these configurations are severely limited under certain adverse gravity situations. A partial solution to this problem is the addition of a percolator channel to the heat pipe. This channel enables the transport of large quantities of working fluid to evaporative surfaces which are substantially higher with respect to gravity than are the condensor surfaces.

The present invention builds upon the basic percolator channel concept.

SUMMARY OF THE INVENTION

The present invention is intended as a subsystem of a larger heat transfer system involving the transfer of thermal energy through heat pipes.

The terms "heat transformer, thermal transformer, and transformer" shall be hereinafter applied to any chamber of the present subsystem which acts primarily as a thermal link between (1) any heat source external to the system and (2) the system itself, and in which the principal means of heat transfer is the evaporation or boiling of a working fluid contained within said chamber followed by the condensation of said working fluid upon the exterior surfaces of a plurality of heat pipes which thermally connects said chamber with other chambers of the system.

The transformer of the present invention can be powered by any type of heat source.

BRIEF DESCRIPTION OF THE DRAWINGS

FIG. 4 is a cross-sectional radial schematic view of a second embodiment of the present invention.

FIG. 5 is a cross-sectional fragmentary view of one embodiment of the evaporator surfaces.

FIG. 6 is a cross-sectional fragmentary view of a second embodiment of the evaporator surfaces.

FIG. 7 is a longitudinal cross-sectional view of the fin structure of the heat pipes.

FIG. 8 is a radial cross-sectional view of the fin structure of the heat pipes.

DETAILED DESCRIPTION OF THE INVENTION

Figure 1:
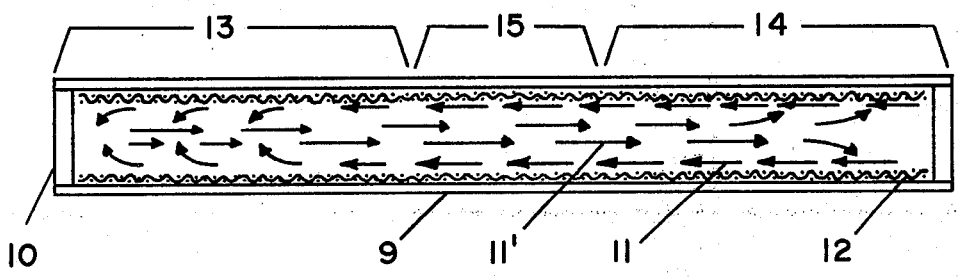
FIG. 1 is a cross sectional schematic view of a heat pipe.

The primary mode of heat transfer in a heat pipe system is the evaporation and condensation of a working fluid in both a thermal transformer 18 and through one or more heat pipes 20, 22, 24 and 26. See FIG. 1.

The transformer 18 functions to convert (or transform) the conventionally high and non-uniform heat fluxes on the exterior of the transformer 18, into lower and more uniform heat fluxes. Said heat pipes serve as thermal conductors and as heat transfer mediums to the several chambers 26, 28, 30 and 32. A secondary heat transfer can be obtained by ancilliary heat pipes 33 disposed within or between said chambers 26, 28, 30 and 32.

It is to be noted that the working fluid utilized within the transformer 18 need not necessarily be the same as the working fluid utilized within said heat pipes 20 thru 26 or in chambers 26 thru 32.

Figure 2:
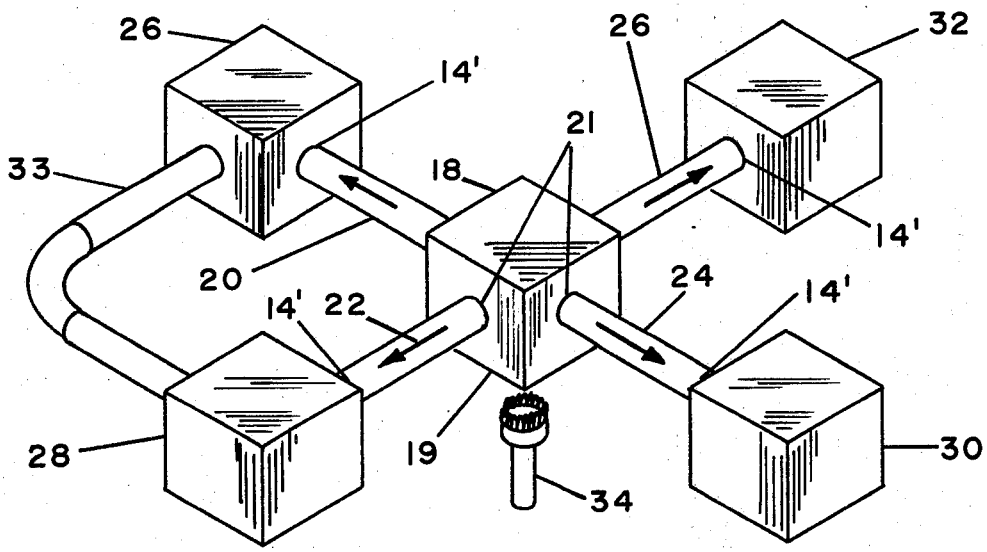
FIG. 2 is a representation of a heat system which can embody the transformer of the present invention.

The transformer 18 is heated by an ultimate heat source 34. This source may be a gas flame, an oil burner fire box, an electric heater, or any other source of thermal energy, and is intended to supply the primary heat in required amounts to the system. In the embodiment of FIG. 2, the heat source 34 is applied to the transformer 18. It is, however, to be emphasized that alternate arrangements could be equally suitable in any given application. For example, the system of FIG. 2 could, with minor adaptations, have the heat source 34 applied to one of the chambers 26 and 32.

The chamber 18 to which the heat source 34 is applied should contain (in addition to its enclosing walls) a working fluid 41 (which may from time to time be frozen) and its vapor 41' (see FIG. 3) as well as evaporation surfaces 42, condensation surfaces 38, a pressure release safety valve 43, and any temperature and/or pressure sensitive control devices (not shown) that may be required in the solving of a particular heating problem.

The primary purpose in the use of a transformer, as opposed to the direct application of the heat source 34 to the evaporator ends of the heat pipes 20 through 26, is to create a uniformity in the heat flux (noted by the four arrows in FIG. 2) from the heat source 34 to the chambers 26 through 32.

In addition to providing the system with a uniformity in its heat gradient, the transformer 18 also serves to reduce the possibility of a phenomenon which is known as heat pipe burnout. Heat pipe burnout occurs when the rate of evaporation in the evaporator section 13 of a heat pipe exceeds the rate of condensate return 11 to the evaporator section (See FIG. 1) and the evaporator becomes dried out. In such a condition, a heat pipe cannot function.

Figure 3:
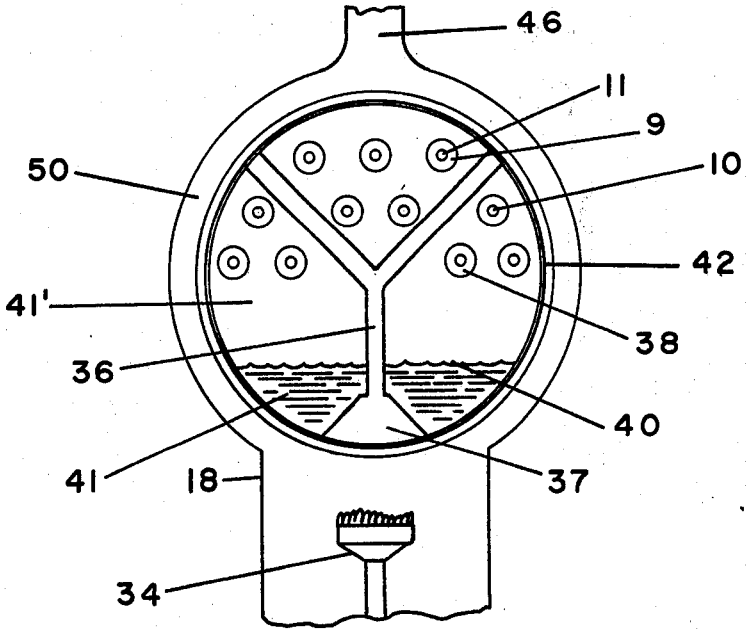
FIG. 3 is a cross-sectional radial schematic view of one embodiment of the present invention.

In theory, the system shown in FIG. 2 need comprise only a single heat pipe. However, experimentation has shown that a more efficient operation can be obtained where a plurality of heat pipes are enclosed within the transformer 18. A representative configuration of such multiple heat pipes, enclosed within the transformer, is illustrated in FIG. 3.

A Y-shaped channel 36 (see FIG. 3) is termed a percolation channel. A collector 37 serves to collect vapor bubbles which provide a means for pumping working fluid via the percolation channel to the upper extremities of the transformer. In doing so, the heat flux across the transformer evaporation surfaces 42 is greatly increased because of this added condensate return mechanism.

An additional condensate return mechanism, that of a gravity return of the condensate from the condensor surfaces 38, is aided by the use of parallel radial fins 39. Said parallel radial fins, when properly spaced, aid the condensate return by virtue of a miniscus which forms between adjacent fins 39 and on the lower fin surfaces.

As droplets fall from said lower surfaces, surface tension forces resulting from said miniscus serve to draw condensate in the form of a falling film from the upper surfaces of said parallel fins. It is believed that this phenomenon can increase the heat transfer due to the condensation on the underside of any horizontal surface by as much as five fold, as compared to condensation return without the formation of said miniscus and its resultant surface tension forces. The primary reason for increased heat transfer is the reduction of the fluid film thickness as a result of said falling film phenomenon.

It has also been found that the design of FIG. 3 will operate at maximum efficiency where each pipe 10 is aligned in its own vertical plane. Such alignment provides each pipe with its own dripping path to a lower region 40. Hence, the fluid transport process within the transformer 18 is further assisted.

Heat may enter the transformer by means of conduction through one or more of its walls 50, and then through evaporator surfaces 42. Since the working fluid and its vapor are in their normal condition, in a state of equilibrium, the addition of any heat to the chamber 18 will cause a shift in the equilibrium state, favoring the evaporation of the working fluid. When this occurs, the latent heat of vaporization of the working fluid is transferred to the heat pipes 10 by the condensation of vapor 41' on said heat pipes' exterior surfaces. The heat is then transferred axially (see arrows of FIG. 2) away from the transformer by the internal dynamics of said heat pipes.

Thus, heat, transferred through the evaporator surfaces 42 as a result of a finite temperature difference across said surface, will cause portions of the working fluid 41 to vaporize or boil, thereby absorbing the latent heat of vaporization of the liquid phase of the fluid. As a result of the pressure gardient induced by said vapor formation, the vapor 41' is forced into regions of lower pressure and, consequently, of lower temperature. Within the transformer 18, these regions of lower pressure and temperature are in the vicinity of the heat pipes 10 which pass through the transformer. Because the heat pipes 10 are at an equilibrium temperature which is lower than that of the newly created vapor 41', said vapor will condense on the exterior finned surfaces 39 of said heat pipes 10, and in doing so, deposit the latent heat of vaporization of said working fluid 41 on said finned surfaces 39.

The regions of lower pressure and temperature, which correspond to condenser section 14 of FIG. 1, are disposed within the chambers 26, 28, 30 and 32 of FIG. 2 at regions 14'. The heat deposited in regions 14' will conduct through the walls of said heat pipes 10 to the mediums contained within chambers 26 thru 32, in a manner which is extremely efficient and uniform.

In the event that source 34 is inactive, and that one or more of the media contained within chambers 26 to 32 reside at a temperature which is different from the temperature at which one medium within one of the chambers resides, said temperature gradient will be sufficient to promote heat transfer from a medium residing at higher temperature to a medium residing at lower temperature.

Heat transfer to the media contained within chambers 26 to 32 from the thermally connective heat pipes may be effected by any transfer means, that is, by conduction, convention, radiation, or the evaporation and condensation of a working fluid, or any combination of these. In attaining said various heat transfer modes, the thermally conductive heat pipes 10 may be variously smooth, rough, or thin in any manner so as to (1) regulate their heat transfer or (2) form a heat pipe surface from or to the medium in contact with said surface.

Illustrated in FIG. 4 is a second embodiment of the present heat transformer 18'. The heat source 34' causes a rapid formation of vapor bubbles at point 70. These bubbles are permitted to escape through a vertical perk tube 72. Droplets and slugs of working fluid from a pool 74 of working fluid are entrained by virtue of the movement of said bubbles through the pool 74 into the perk tube 72. Liquid from a primary pool of working fluid 40' is returned to pool 74 via open communication at points 90.

Entrainment is a phenomenon which relates to the interfacial forces developed in two phase flow, in particular, a liquid vapor flow. The flow of vapor past a liquid sets up a force equilibrium between the surface tension of the liquid and the shear of the vapor. As the interfacial shear forces exceed the surface tension forces of the liquid, the interface becomes unstable and liquid droplets are torn from the pool and entrained in the vapor.

In the present application, the entrainment is induced by the proper sizing of the following parameters. First, the vapor collector 37' must be of sufficient magnitude to collect sufficient vapor to perform the entraining of the liquid droplets. Next, the internal cross-sectional area of the perk tube(s) must be sized to allow a high vapor velocity, yet must also be sized to allow relatively low surface tension effect for the liquid. For the particular case where water is used for a working fluid within the transformer, round perk tubes of approximately ¼ inch inside diameter have been found to function well.

In the present application, a secondary reservoir 82, located higher with respect to gravity than the primary pool of working fluid 40', functions to store a reserve of working fluid at a elevation which is higher with respect to gravity than most of the transformer evaporator surfaces 42'. A capillary wick structure 79 is located within secondary reservoir 82 and is in capillary communication with a wick structure 78, which covers evaporator surfaces 42'. The capillary wick structure 78 might typically consist of a metallic mesh 96, shown in FIG. 5 or a series of intergral grooves 97 in the evaporator 42' shown in FIG. 6.

Also incorporated in the secondary reservoir is a means of open communication, a vapor vent 83, between the secondary vapor space 81 and the primary vapor space 41'. This communication prevents any potential pressure build-up in the secondary vapor space 81', without allowing any fluid leakage from the secondary reservoir 82.

Operation of the improved system is as follows. The flue gases from the primary heat source contact the external surface of the transformer over its entire circumference (in the case of a cylindrical transformer). The highest temperature gases impinge on the lowest surface of the transformer 84 opposite the vapor collector 37'. Vapor bubbles are generated at evaporator surface at 70 and in pool 74. These bubbles are forced to escape through perk tube(s) 72. In doing so, fluid droplets and slugs are entrained from pool 74 and elevated to secondary reservoir 82. As the secondary reservoir 82 becomes wet, capillary communication at points 80 allows a continual flow of working fluid with or without the aid of gravity, across evaporator surfaces 42′. Capillary communication in between primary pool of working fluid 40′ and evaporator surface 42′ allows additional fluid to flow across said evaporator surfaces 42′.

As the flue gas 86 passes over the external surfaces 84, 85 of transformer, heat absorbed by the surfaces 84, 85, causes evaporation of working fluid from evaporation surfaces 42′. All of the vapor which is generated at evaporator surfaces 42, over the entire inside circumference of the transformer, is condensed at condensor surfaces 38′ on the outside of the several heat pipes 10′, which in turn transport the latent heat of condensation to other parts of the system. The condensate 39′ is returned to the primary pool of working fluid 40′ from which it continues the cycle.

The addition of the percolation channel and secondary reservoir to the transformer aids greatly in maintaining wetted evaporator surfaces even at substantial elevations above the primary pool of working fluid. These wetted surfaces allow for much more efficient and uniform heat transfer to the system.

More particularly, it is, in FIGS. 7 and 8, noted that the fins 39 of the heat pipe are parallel to each other and, further, are disposed sufficiently close to each other in order to permit the formation of a minuscous 94 therebetween, thereby contributing to the phenomenon of falling film condensation, shown schematically as reference element 95.

It is to be understood that the transformers of the present invention, and their associated plurality of heat pipes, may serve as a means of thermally linking, and thereby thermally powering any heating or cooling system. Viewed in this light, it can be appreciated that the hereinafore described embodiments represent but two of a multiplicity of systems to which the present concepts may be readily applied.

While there have been herein shown and described the preferred embodiments of the present invention, it will be understood that the invention may be embodied otherwise than is herein specifically illustrated or described and that in the illustrated embodiment certain changes in the detail of construction and in the form and arrangement of parts may be made without departing from the underlying idea or principles of this invention within the scope of the appended claims.

Having thus described our invention what we claim new, useful and non-obvious and accordingly secure by Letters Patent of the United States is:

1. A heat transfer system comprising:

a. a heat source;

b. a heat pipe;

c. a thermal transformer in thermal contact with said heat pipe and proximately disposed to said heat source, said thermal transformer comprising:

i. a container;

ii. a working fluid and its vapor, said fluid and said vapor being essentially in equilibrium;

iii. evaporating surfaces depending from the internal surfaces of said transformer that are wetted by said working fluid and that are proximate to said heat source;

iv. condensing surfaces depending from the exterior of those areas of said heat pipe that are in thermal contact with said transformer;

v. a wick structure affixed to the interior surface of said transformer and in contact with said evaporating surfaces, said transformer being sealed while under a partial vacuum, said vacuum being measured exclusively of partial pressures contributed by said working fluid; and vi. means for non-capillary pumping of said working fluid to higher regions of said wick structure, said higher regions being defined with respect to the gravity field; and d. a first chamber containing a medium with defined heat transfer characteristics, said chamber thermally coupled to said heat pipe, whereby transfer from said heat source to said medium is obtained.

2. The system as recited in claim 1 in which of said heat pipes is disposed in a vertical plane that does not intersect the vertical plane of any other said heat pipes.

3. The system as recited in claim 2 in which the working fluid of the transformer is water and the working fluid of said heat pipes are also water.

4. The system as recited in claim 2 in which the working fluid of said transformer is different from the working fluid of said heat pipe.

5. The system as recited in claim 1 in which said system further comprises: a flue structure peripherally surrounding said thermal transformer and said heat source.

6. The system as recited in claim 1 in which said means for non-capillary pumping comprises: a perculation channel having one end, a collector at that interior surface of said transformer that is proximate to said heat source, submerged by a pool of working fluid, and having a plurality of opposite ends disposed at said higher regions of said transformer.

7. The system as recited in claim 1 in which said condensing surface of said heat pipes comprises a multiplicity of fins projecting radially from said heat pipes.

8. The system as recited in claim 7 in which said fins are parallel to each other and are disposed sufficiently close to each other in order to permit the formation of a meniscus therebetween, thereby contributing to the phenomenom of falling film condensation.

9. The system as recited in claim 1 in which said secondary reservoir of working fluid has capillary means of communication with said evaporator surfaces of said transformer.

10. The system as recited in claim 9 in which said secondary reservoir has a secondary vapor space, said secondary vapor space has open non-capillary means of communications with the primary vapor space of said transformer.

* * * * *